US005132738A

United States Patent [19]

Nakamura et al.

[11] Patent Number: 5,132,738

[45] Date of Patent: Jul. 21, 1992

[54] IMAGE FORMING APPARATUS WITH CLEANING MECHANISM FOR CHARGING ELECTRODE

[75] Inventors: Shunji Nakamura, Yokohama; Hiroki Kisu, Ichikawa; Yohji Tomoyuki, Yokohama; Masanobu Saito, Yokohama; Junji Araya, Yokohama; Toshio Miyamoto, Tokyo, all of Japan

[73] Assignee: Canon Kabushiki Kaisha, Tokyo, Japan

[21] Appl. No.: 789,547

[22] Filed: Nov. 8, 1991

Related U.S. Application Data

[63] Continuation of Ser. No. 707,967, May 23, 1991, abandoned, which is a continuation of Ser. No. 290,763, Dec. 27, 1988, abandoned.

[30] Foreign Application Priority Data

| | | | |
|---|---|---|---|
| Dec. 28, 1987 | [JP] | Japan | 62-336485 |
| Jan. 18, 1988 | [JP] | Japan | 63-6845 |
| May 20, 1988 | [JP] | Japan | 63-121952 |
| Jun. 17, 1988 | [JP] | Japan | 63-148078 |
| Jun. 18, 1988 | [JP] | Japan | 63-149272 |

[51] Int. Cl.[5] ..... G03G 15/16

[52] U.S. Cl. ..... 355/274; 355/219; 355/271; 355/296

[58] Field of Search ..... 355/219, 271, 274, 277, 355/296, 297, 268; 346/160.1

[56] References Cited

U.S. PATENT DOCUMENTS

| | | | |
|---|---|---|---|
| 3,520,604 | 7/1970 | Shelffo | 355/212 |
| 4,171,157 | 10/1979 | Suzuki . | |
| 4,183,655 | 1/1980 | Umahashi et al. | 355/274 |
| 4,363,861 | 12/1982 | Nakamura et al. . | |
| 4,387,980 | 6/1983 | Ueno et al. | 355/219 |
| 4,391,512 | 7/1983 | Nakamura et al. . | |
| 4,563,978 | 1/1986 | Nakamura et al. . | |
| 4,638,760 | 1/1987 | Nakamura et al. . | |
| 4,674,865 | 6/1987 | Tada et al. . | |
| 4,712,908 | 12/1987 | Nakayama et al. . | |
| 4,851,960 | 7/1989 | Nakamura et al. . | |
| 5,006,902 | 4/1991 | Araya | 355/271 |

FOREIGN PATENT DOCUMENTS

| | | | |
|---|---|---|---|
| 3512875 | 11/1985 | Fed. Rep. of Germany . | |
| 53-77533 | 7/1978 | Japan . | |
| 54-63837 | 5/1979 | Japan . | |
| 55-45059 | 3/1980 | Japan | 355/268 |
| 56-39472 | 4/1981 | Japan . | |
| 56-123577 | 9/1981 | Japan . | |
| 61-53688 | 3/1986 | Japan . | |
| 63-88582 | 4/1988 | Japan | 355/277 |

OTHER PUBLICATIONS

IBM Technical Disclosure Bulletin, vol. 24, No. 1 B Jun. 1981 "Switch Regulation of High Voltage Corona Supplies".

*Primary Examiner*—Joan H. Pendegrass

*Attorney, Agent, or Firm*—Fitzpatrick, Cella, Harper & Scinto

[57] ABSTRACT

An image forming apparatus includes a movable image bearing member, a charger for electrically charging the image bearing member, latent image forming device for forming a latent image with use of the charger, a developing device for developing the latent image formed by the latent image forming device with toner electrically charged to a polarity the same as a polarity to which the image bearing member is charged by the charger, image transfer member contactable to a back side of a transfer material to transfer a toner image provided by the developing device from the image bearing member to the transfer material, a voltage application device for applying a voltage to the transfer member, the voltage application device applying a voltage having a polarity the same as that of the toner to the transfer member during non-transferring operation, and a device for providing different potentials for a portion of the image bearing member to be opposed to the image transfer device during the non-transfer action by said image transfer member and for a portion of said image bearing member to be opposed to said image transfer member during transfer action by the image transfer member.

92 Claims, 10 Drawing Sheets

IMAGE FORMING APPARATUS WITH CLEANING MECHANISM FOR CHARGING ELECTRODE

This application is a continuation of application Ser. No. 707,967 filed May 23, 1991 now abandoned; which is a continuation of Ser. No. 290,763 filed Dec. 27, 1988, now abandoned.

FIELD OF THE INVENTION AND RELATED ART

The present invention relates to an image forming apparatus using an electrostatic image transfer process such as an electrostatic copying machine or printer, more particularly to such an image forming apparatus provided with a charging electrode for charging an image bearing member.

An image forming apparatus is known wherein a surface of a photosensitive layer of an image bearing member in the form of a rotatable cylinder is electrically charged by a corona charging device; an electrostatic latent image is formed thereon; the electrostatic latent image is developed; and the developed image is transferred by passing a transfer material (a sheet of paper) through a nip formed between the image bearing member and a transfer drum or roller (charging electrode) press-contacted to the image bearing member, wherein a transfer bias is applied to the transfer roller to transfer the developed (toner) image from the image bearing member surface to the transfer material or sheet.

Such an apparatus involves the problem of the transfer roller becoming significantly contaminated when the image of the original is larger than the size of the transfer material so that the toner is directly transferred from the image bearing member to the transfer roller or when a jam occurs during image forming operation. If the contamination of the roller takes place, the subsequent transfer material is contaminated, or the transfer bias is substantially decreased with the result that the image transfer insufficient.

In order to avoid this problem, a proposal has already been made that the transfer roller be supplied, during non-transfer operation, with a bias voltage having a polarity opposite to that during the image transfer operation, by which the toner is intentionally transferred to the image bearing member, thus cleaning the transfer roller, as disclosed in Japanese Laid-Open Patent Application Publication 63837/1979 and Japanese Laid-Open Patent Application No 123577/1981, for example.

However, the electric field for transferring the toner from the transfer roller to the image bearing member can be insufficient, only by applying the bias voltage having the opposite polarity (the same polarity as the toner) during the non-transfer operation, described above. Therefore, the transfer roller is not sufficiently cleaned. Recently, a printer of an electrophotographic type using a laser beam or LED elements becomes widely used because computers are widely used. In the printer like this, in order to minimize the light emitting period of the light source to increase the service life, it is frequent that the light is projected to such an area as is going to become an image portion (not background portion) after development, and therefore, the latent image is reverse-developed. When the reverse-development type is used, the polarity of the electrically charged image bearing member and the polarity of the bias voltage applied to the transfer roller for the cleaning are the same, unlike the case of regular development, during non-transfer operation (no sheet between the roller and the image bearing member), and therefore, sufficient electrostatic contrast for the cleaning is not provided.

SUMMARY OF THE INVENTION

Accordingly, it is a principal object of the present invention to provide an image forming apparatus wherein toner particles deposited on a charging electrode are transferred to an image bearing member, thus cleaning the charging electrode.

It is another object of the present invention to provide an image forming apparatus wherein contamination toner particles are removed from a charging electrode, whereby a good quality image is stably provided.

In accordance with the above objectives there is provided an image forming apparatus, comprising a movable image bearing member, means for electrically charging the image bearing member to a first potential, latent image forming means for forming a latent image with use of the charging means, developing means for developing the latent image formed by the latent image forming means with toner electrically charged to a polarity the same as the polarity of the first potential, image transfer means contactable to a back side of a transfer material at a transfer position to transfer a toner image provided by the developing means from the image bearing member to the transfer material, voltage application means for applying a voltage to the image transfer means, the voltage application means applying a voltage having a polarity the same as that of the toner to the image transfer means during non-transfer action by the transfer means; and means for providing a second potential for that portion of the image bearing member which is to be presented to the transfer position during voltage application by the voltage application means, wherein the second potential is different from the first potential and more remote from the electric charge of the toner than from the first potential.

In another aspect, there is provided an image forming apparatus, comprising a movable image bearing member, charging means for electrically charging the image bearing member to a first potential, latent image forming means for forming a latent image on the image bearing member with use of the charging means, developing means for developing the latent image formed by the latent image forming means with toner, image transfer means contactable to a back side of a transfer material at a transfer position to transfer a toner image provided by the developing means from the image bearing member to the transfer material, potential application means for applying to the image transfer means a second potential during non-transfer action of the image transfer means to form an electric field to transfer the toner from the transfer means to the image bearing member, and a third potential during transfer action of the image transfer means; and means for providing the image bearing member with such a potential that a difference between the second potential and a potential of that portion of the image bearing member which is to be presented to the transfer position during application of the second potential, is larger than a potential difference between the second potential and the first potential and more remote from the electric charge of the toner than from the first potential.

In yet another aspect, there is provided, an image forming apparatus, comprising, a movable image bearing member, charging means for electrically charging the image bearing member to a first potential, latent image forming means for forming a latent image on the image bearing member with use of the charging means, developing means for developing the latent image formed by the latent image forming means with toner, image transfer means contactable to a back side of a transfer material at a transfer position to transfer a toner image provided by the developing means from the image bearing member to the transfer material, potential application means for applying a voltage to the image transfer means a second potential during non-transfer action of the image transfer means to form an electric field to transfer the toner from the transfer means to the image bearing member, and a third potential during transfer action, means for providing a fourth potential for that portion of the image bearing member which is to be presented to the transfer position during the second voltage application by the voltage application means, wherein the fourth potential is lower than the first potential, wherein the transfer means is press-contacted to the image bearing member with a pressure not more than 300 g/cm$^2$.

In still yet another aspect, there is provided, an image forming apparatus, comprising, a movable image bearing member, charging means for electrically charging the image bearing member to a first potential, latent image forming means for forming a latent image on the image bearing member with use of the charging means, developing means for developing the latent image formed by the latent image forming means with toner, image transfer means contactable to a back side of a transfer material at a transfer position to transfer a toner image provided by the developing means from the image bearing member to the transfer material, potential application means for applying a voltage to the image transfer means a second potential during non-transfer action of the image transfer means to form an electric field to transfer the toner from the transfer means to the image bearing member, and a third potential during transfer action, means for providing a fourth potential for that portion of the image bearing member which is to be presented to the transfer position during the second voltage application by the voltage application means, wherein the fourth potential is different from the first potential, wherein the transfer means has a rubber hardness of not greater than 30 degrees (JISA).

In a further aspect, there is provided an image forming apparatus, comprising , a movable image bearing member, image forming means for forming a toner image on the image bearing member, image transfer means contactable to a back side of an image transfer material at a transfer position to transfer the toner image from the image bearing member to the transfer material, electric field forming means for forming an electric field between the image bearing member and the transfer means, the electric field forming means forming a first electric field effective to transfer the toner from the transfer means to the image bearing member and a second electric field bearing a direction opposite to that of the first electric field, when the transfer material is not present at the transfer position.

In still yet a further aspect there is provided an image forming apparatus, comprising, a movable image bearing member, means for electrically charging the image bearing member to a first potential, toner image forming means for forming a toner image on the image bearing member, image transfer means contactable to a back side of a transfer material at a transfer position to transfer the toner image from the image bearing member to the transfer material, potential application means for applying a second potential to the transfer means when the transfer material is not at the transfer position, potential providing means for providing a third potential for that portion of the image bearing member which is to be presented to the transfer position during potential application by the potential applying means, the third potential being more remote from toner charge than the first potential.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
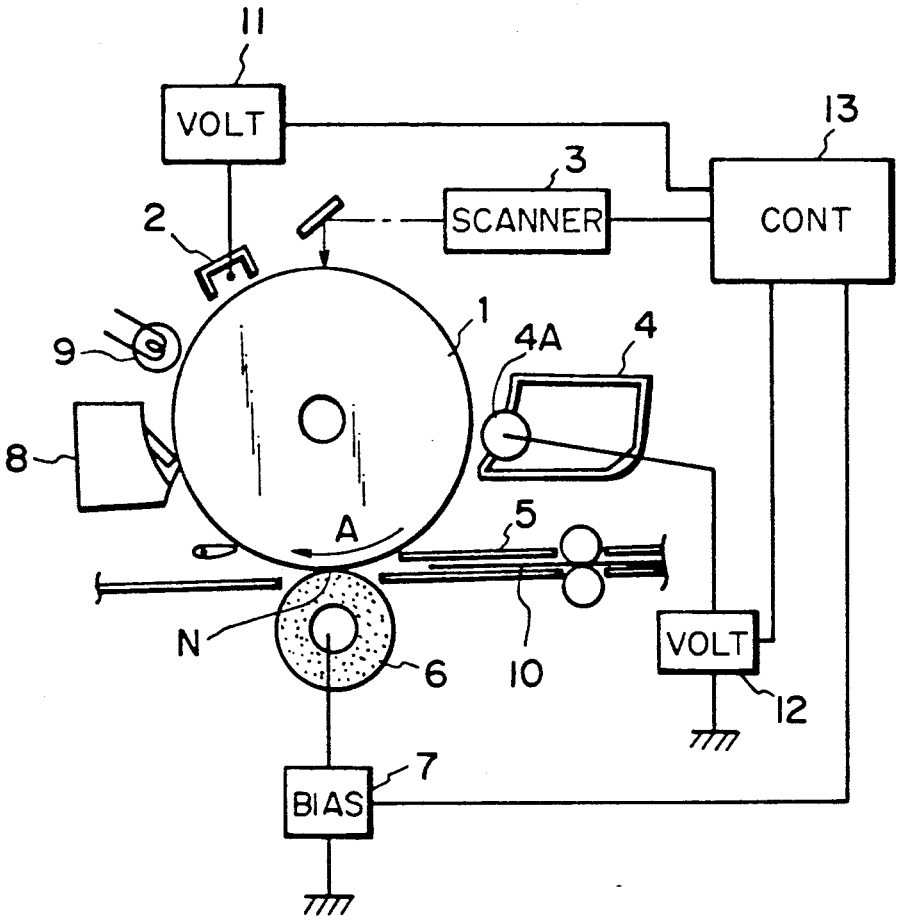
FIG. 1 is a sectional view of an image forming apparatus according to an embodiment of the present invention.

Referring to FIG. 1, there is shown an image forming apparatus usable with the present invention. The image forming apparatus comprises a photosensitive member 1 extending in a direction perpendicular to the sheet of the drawing and rotatable in a direction indicated by an arrow A. The surface of the photosensitive member 1 is uniformly charged by a corona charger 2, and thereafter, light is projected thereonto in accordance with an image signal, so that an electrostatic latent image is formed. When the latent image reaches a developing device 4, the latent image is visualized with the toner.

When the toner image reaches a nip N formed between the photosensitive member 1 and a transfer roller 6 (charging electrode) made of conductive rubber, a transfer material 10 reaches the nip N because it is supplied thereto through a conveyance passage 5 with timed relation with the latent image. Then, a transfer bias is applied to the transfer roller 6 from a power source 7, so that the toner image is transferred onto the transfer material. Referring back to the charger 2, it is supplied with a voltage for charging the photosensitive member (image bearing member) 1 from the power source 11, whereas a developing sleeve 4A of the developing device 4 is supplied with a developing bias voltage from a power source 12.

The transfer material discharged from the nip N is further advanced in the leftward direction to an unshown image fixing station, where the unfixed toner image on the transfer material 10 is fixed thereon.

The toner on the photosensitive member 1 which is not transferred to the transfer material during the transfer operation reaches with rotation of the photosensitive member to a cleaning device 8 where remaining toner is removed from the photosensitive member. The electric charge remaining on the surface of the photosensitive member is erased by illumination by a discharging lamp 9, so that the photosensitive member 1 is prepared for the next image forming operation.

The image forming apparatus shown in the Figure is a laser beam printer of an electrophotographic type. The latent image formation and image transfer therein will be described. The photosensitive member 1 is provided with an organic photoconductor (OPC) layer and is charged to −700 V by the corona charger 2 and is exposed by a laser scanning device 3 to a laser beam modulated in accordance with an image signal by a controller 13. Such an area of the photosensitive member 1 as will become an image portion (characters or the like) after development is exposed to the laser beam. By the image exposure, the image portion potential attenuates to −100 V, so that a latent image is formed. In the developing device 4, the toner having been charged to the same polarity as the charge applied to the photosensitive member 1 by the corona charger 2, that is, negatively charged toner is supplied thereto, whereby the toner is deposited to such an area where the potential is attenuated by the application of the laser beam, so that a toner image is formed. That is, the latent image is reverse-developed. The toner image now formed on the photosensitive member 1 reaches, with rotation of the photosensitive member 1, to the nip N, where a transfer material 10 supplied through the conveyance passage 5 is contacted to the photosensitive member 1, so that the transfer material 10, the photosensitive member 1 and the transfer roller are advanced at the same speed. The transfer roller 6 is supplied with a transfer bias of +500 V (the polarity opposite to the charge of the toner) from the power source 7, by which an image transfer electric field is formed, so that the toner image is transferred from the photosensitive member 1 to the transfer material 10.

The material of the photosensitive member 1 described above is not limiting, but may be amorphous silicon, selenium, ZnO or the like.

As will be understood from FIG. 1, the power source 11 for the corona charger 2, the laser exposure device 3, the power source 12 for the developing sleeve 4A and the power source 7 for the transfer roller 6 are on-off controlled by the controller 13. In this embodiment, a non-image formation area (an area which is to correspond to non-passage of the transfer material when it reaches to the transfer station, or an area which is to correspond to non-exposure period of the photosensitive member to the light information), is not subjected to the charging operation, since the charger 2 is not energized, whereby the surface potential of the photosensitive member 1 in such an area is 0 V.

During the period in which the non-charged region having the surface potential of 0 V is in the developing zone where it is opposed to the developing device, the developing bias applied to the developing sleeve is not supplied, or otherwise, the developing bias is switched to a positive polarity, to prevent deposition of the toner to the photosensitive member 1.

In a printer using a laser beam, the quantity of laser output varies in dependence on the temperature and humidity. To compensate for this, it is usual that the laser beam is continuously produced, and the amount of light is detected, during each non-image formation period (between adjacent printing periods in the case of continuous printing, or pre-rotation period in the case of one print) to maintain a constant quantity of light. If the photosensitive member 1 is charged when supplied with the laser beam application for the constant quantity maintenance of the laser beam light, the potential of the portion exposed to the laser beam attenuates, and therefore, two surface potential portions, i.e., −700 V and −100 V are produced. It is difficult to provide a developing bias which prevents deposition of the toner to both of the areas due to a problem of production of a foggy background attributable to reversely charged toner which is charged to a polarity opposite to the polarity of almost all of the toner particles and which is possibly contained in the developer and due to the problem of deposition of carrier particles (when the developer is constituted by toner particles and carrier particles charged to a polarity opposite to that of the toner particles). In this embodiment, however, the surface potential of the photosensitive member is zero, and therefore, the bias voltage preventing the toner deposition can be selected form a wide range.

For example, when a magnetic brush development using a DC bias voltage and using a two component developer (containing toner and carrier particles) is employed the developing bias for the non-image formation area can be selected from a range of several hundreds of volts when the surface potential of the photosensitive member is near 0 V, from the standpoint of prevention of deposition of the developer to the photosensitive member.

In the case where a so-called jumping development wherein a one component insulative magnetic developer is used, and a thin developer layer on the developing sleeve is opposed to the photosensitive member with a clearance in the developing zone, where an alternating electric field formed by superposing and an AC voltage and a DC voltage is applied across the developing zone, the developing bias for preventing toner deposition to the photosensitive member can be selected from wide variations including the weakening only of the peak-to-peak voltage of the AC voltage component for the non-image formation area, the shutting-off thereof for the non-image formation area, the changing of the DC component for the non-image formation area, or shutting-off both of them. By this, the contamination of the transfer roller contacted to the non-image formation area of the photosensitive member 1 can be prevented.

When the non-image formation area of the photosensitive member 1 is in the image transfer region where the photosensitive member 1 and the transfer roller 6 are press-contacted, that is, during the non-transfer operation, further in other words, when the transfer material is not passed through the transfer region, the photosensitive member 1 is directly contacted to the transfer roller 6, which supplied with a bias voltage of the same polarity as the toner, for example, −500 V to drive the negative toner from the transfer roller 6 to the photosensitive member 1. In other words, the absolute value of the surface potential of the photosensitive member 1 during the non-passage of the transfer material is smaller than the absolute value of the bias voltage applied to the transfer roller 6.

Since the surface potential of the photosensitive member 1 is 0 V, for example, an electric field sufficient for transferring the toner from the transfer roller 6 to the photosensitive member 1 is formed with a relatively low voltage, so that the transfer roller 6 is satisfactorily cleaned.

Figure 2:
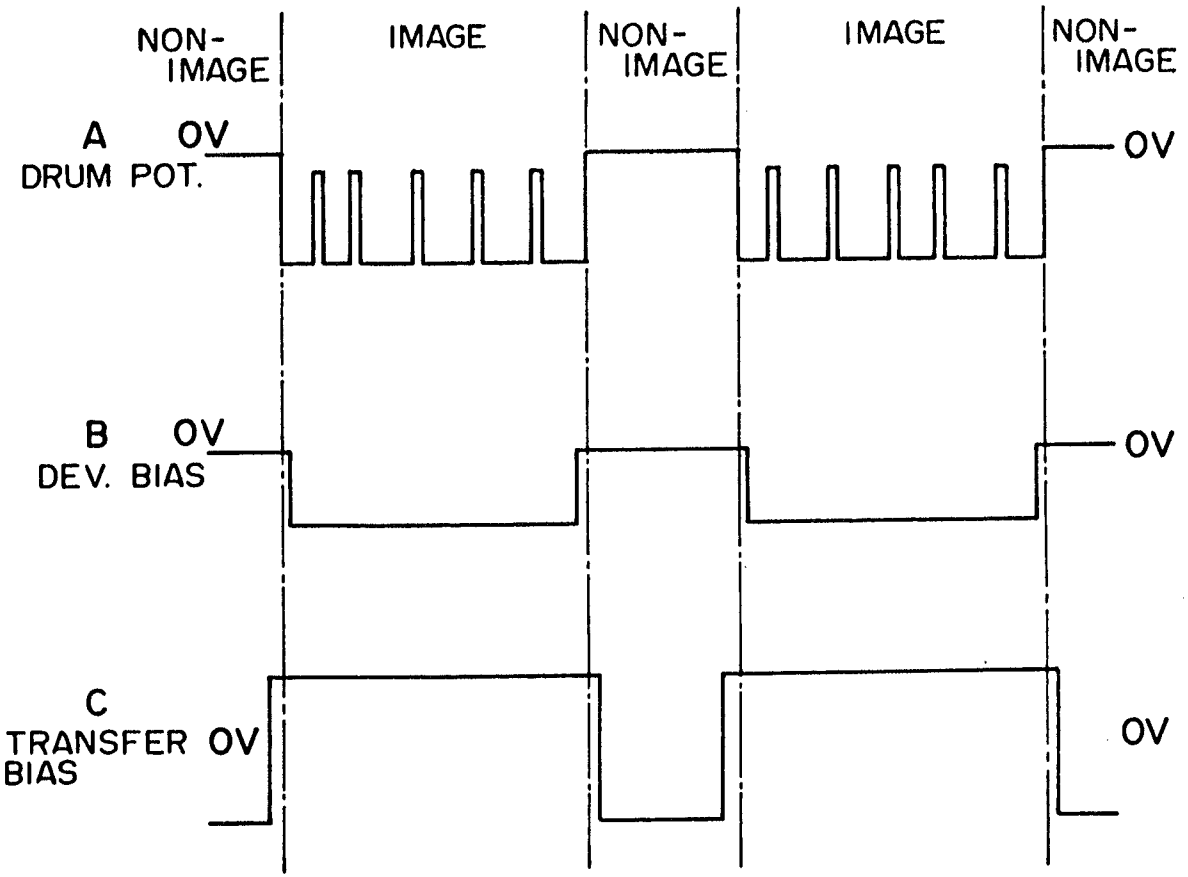
FIG. 2 is a timing chart illustrating an operation of the apparatus according to the embodiment of the present invention.

Referring to FIG. 2, there is shown a timing chart illustrating an operation of the apparatus according to this embodiment, wherein reference A indicates a surface potential of the photosensitive member 1, and the pulse-like portion in the image area indicates a potential pattern provided by the information light application.

Reference character B indicates switching of the developing bias. In the timing of the developing bias application for normal image formation, the non-charged portion is to receive the toner, and therefore, in this embodiment, the switching of the bias voltage is to overlap with the non-passage of the transfer material through the nip between the photosensitive member 1 and the transfer roller 6, that is, the non-image non-charge area.

Reference character C designates timing of the switching of the bias voltage to the transfer roller. The bias voltage is positive when the transfer roller 6 is opposed to the image area of the photosensitive member 1 (during passage of the transfer material), and is negative when the transfer roller 6 is opposed to the non-image area (during the transfer material is not passed).

As described, the developing bias is switched so as to be overlapped with the non-charge portion from the standpoint of deposition of the toner to the photosensitive member 1. Adjacent starting and terminating points of time, the developing bias voltage becomes 0 V under the condition that the surface potential of the photosensitive member is −700 V, and therefore, the normally charged (negative in this case) toner is prevented from deposition. However, a reversely charged toner (positive charged in this case) in the one component developer or the carrier particles positively charged in the two component developer can be deposited to the photosensitive member in the developing device, because a strong reverse electric field is formed for a short period of time. If a bias voltage having the same polarity as the normal toner as described in the foregoing is applied to the transfer roller 6 in the neighborhood where the reversely charged toner or the like is deposited on the photosensitive member, the reversely charged toner and/or the carrier can be transferred back to the transfer roller 6 and can contaminate it. Therefore, it is preferable that the polarity of the bias voltage applied to the transfer roller is switched to the same polarity as that of the normal toner, when the no-charge portion is opposed to the transfer roller, since then the reversely charged toner or the like is not deposited to the photosensitive member.

In the foregoing embodiment, the charger is stopped at the non-image formation area of the photosensitive member 1 (the area of the photosensitive member opposed to the transfer roller when the transfer material is not passed through the nip), but, the charging voltage of the charger may be made smaller than for the image area, or alternatively, a bias voltage for a grid, if it is provide for the corona charger, or may be controlled to decrease the potential of the non-image formation area of the photosensitive member 1.

As a further alternative, the non-image formation area of the photosensitive member 1 maybe charged once by the charger to the same extent as the image formation area, and thereafter, the charge in the non-image formation area of the photosensitive member may be removed or decreased. For example, the potential may be decreased by applying light to the non-image region of the photosensitive member which has once been charged. The potential of the non-image formation area of the photosensitive member is not limited to be 0 V. However, it will suffice if the absolute value of the surface potential of the photosensitive member corresponding to the non-passage of the transfer material is smaller than the absolute value of the bias voltage applied to the transfer roller, when the transfer roller is cleaned.

In the case of increasing the bias voltage applied to the transfer roller 6 rather than decreasing the surface potential of the non-image formation area of the photosensitive member as compared with the image formation area, a high bias voltage is required to be applied to the transfer roller in order to provide a sufficient potential contrast for satisfactorily cleaning the transfer roller. For example, when the surface potential of the photosensitive member 1 is maintained at −700 V in the foregoing embodiment, the bias voltage to the transfer roller is required to be −1200 V, in order to form an electric field to transfer the toner from the transfer roller 6 to the photosensitive member 1 by application of a negative (the same as the polarity of the toner) bias voltage to the transfer roller 6. In order to apply such a high voltage to the transfer roller 6, the power source device becomes bulky, or another problem of leakage of high voltage results.

In order to avoid this, the embodiment of the present invention decreases the potential of the region of the photosensitive member to be opposed or contacted to the transfer roller during non-passage of the transfer material at the transfer station. Further preferably, the potential thereof is 0 V, since then the voltage applied to the transfer roller 6 is small, and the possibility of dielectric break-down of the photosensitive member is reduced, and leakage of current can be prevented. This is particularly effective when the photosensitive member (image bearing member) is of amorphous silicon, OPC or the like having a relatively low durability to the dielectric breakdown.

Figure 3:
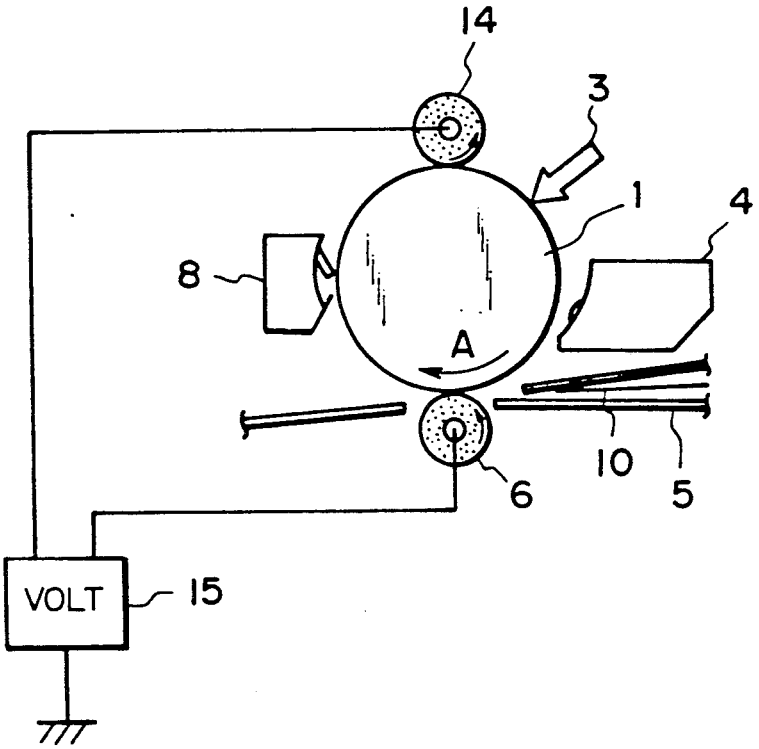
FIG. 3 is a sectional view of an image forming apparatus according to another embodiment of the present invention.

Referring to FIG. 3, there is shown an image forming apparatus according to another embodiment of the present invention, wherein in place of the corona charger 2 of FIG. 1, a charging roller 14 is employed which is made of a conductive rubber and is connected with a source 15 and which is contacted to the photosensitive member 1. The charging roller 14 constitutes a contact type charging device to uniformly charge the surface of the photosensitive member 1. The charging roller 14 is electrically conductive at least a surface thereof, and the resistance is preferably $10^2$–$10^8$ ohm.cm, more particularly, it is a roller of electrically conductive urethane rubber having a resistance of $10^5$ ohm.cm in this embodiment.

In operation, the charging roller 14 is supplied from a power source 15 with a vibratory voltage provided by superimposing a DC voltage of −700 V and an AC voltage having a peak-to-peak voltage of 1500 V and a frequency of 1000 Hz, by which the photosensitive layer of the surface of the photosensitive member 1 can be uniformly charged to −700 V. Here, the vibratory voltage means a voltage in which the level of the voltage periodically changes with time, and the waveform thereof may be triangular, rectangular or pulse-like.

A light image is applied to the surface thus charged so that a latent image is formed, and the latent image is reverse-developed so that negatively charged toner particles are deposited to such an area of the latent image as is exposed to the light and is decreased in the potential, whereby a toner image is formed.

A transfer material 10 is supplied to the photosensitive member in alignment with the toner image. During the transfer operation, the transfer roller 6 is supplied with a DC bias voltage of +500 V, by which a good transferred image can be provided on the transfer material 10.

During non-transfer operation, that is, while the transfer material is not present between the photosensitive member 1 and the transfer roller 6, the transfer roller 6 is supplied with −500 V. In addition, for the area of the photosensitive member 1 which is to be opposed to the transfer roller 6 during the non-transfer operation, the DC component of the voltage applied to the charging roller 14 is shut-off, so that only an AC component is applied, by which the surface of the photosensitive member is uniformly electrically discharged to 0 V.

When image forming operation is repeated with the above-described structure, potential contrast of the latent image due to the remaining charge is present in the area of the photosensitive member 1 upstream the charging roller 14 with respect to rotation of the photosensitive member 1, but in the area downstream thereof the entire surface is uniformly charged to −700 V, so that a pre-exposure lamp which having been required in the conventional apparatus is not necessarily required. This has been confirmed through experiments.

The voltage applied to the charging roller may be constituted only with a DC voltage. However, in order to charge the surface of the photosensitive member to −700 V, a DC voltage of −1200–1300 V is required, and in addition, the uniformness of the surface potential is slightly poorer than when a superposed AC and DC voltage is used with the result that production of a ghost image can not be avoided without provision of the pre-exposure lamp. Therefore, better results can be provided when the superposed voltage is applied to the charging roller 14 than when only a DC voltage is applied.

Figure 4A:
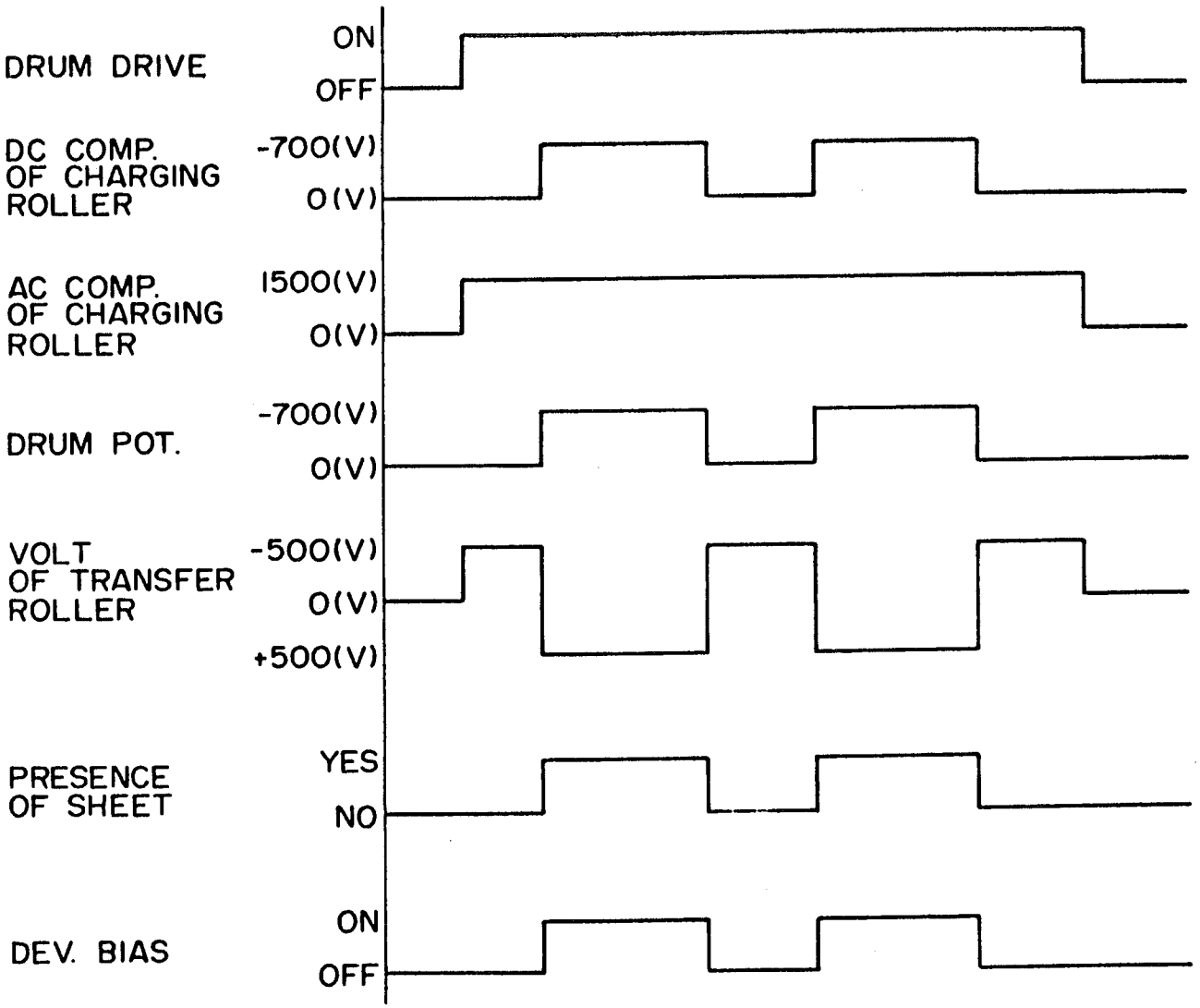
FIGS. 4A and 4B are timing charts illustrating operations of the another embodiment of the present invention.

FIG. 4A shows a sequential operation of application of the voltage during charging, developing and image transferring operations. In this Figure, the time lag resulting from movement of the photosensitive member is omitted. For example, since the time required for a portion of the photosensitive member to move from the charging position to the image transfer position is omitted, it should not be understood in FIG. 4A that the application of the voltage of −700 V for the DC component to the charging roller 14 is simultaneously with initiation of application of the voltage of 500 V to the transfer roller.

In FIG. 4A, during the non-transfer operation in which the transfer material is not present in the nip, the DC component to the charging roller 14 is made 0 V, by which the surface potential of the photosensitive member 1 is made 0 V, and also, the bias voltage to the transfer roller 6 is made −500 V, by which the negatively charged toner can be assuredly transferred to the photosensitive member. In this portion, it is preferable that the developing bias is made zero, since then the toner is not transferred without charging.

Figure 4B:
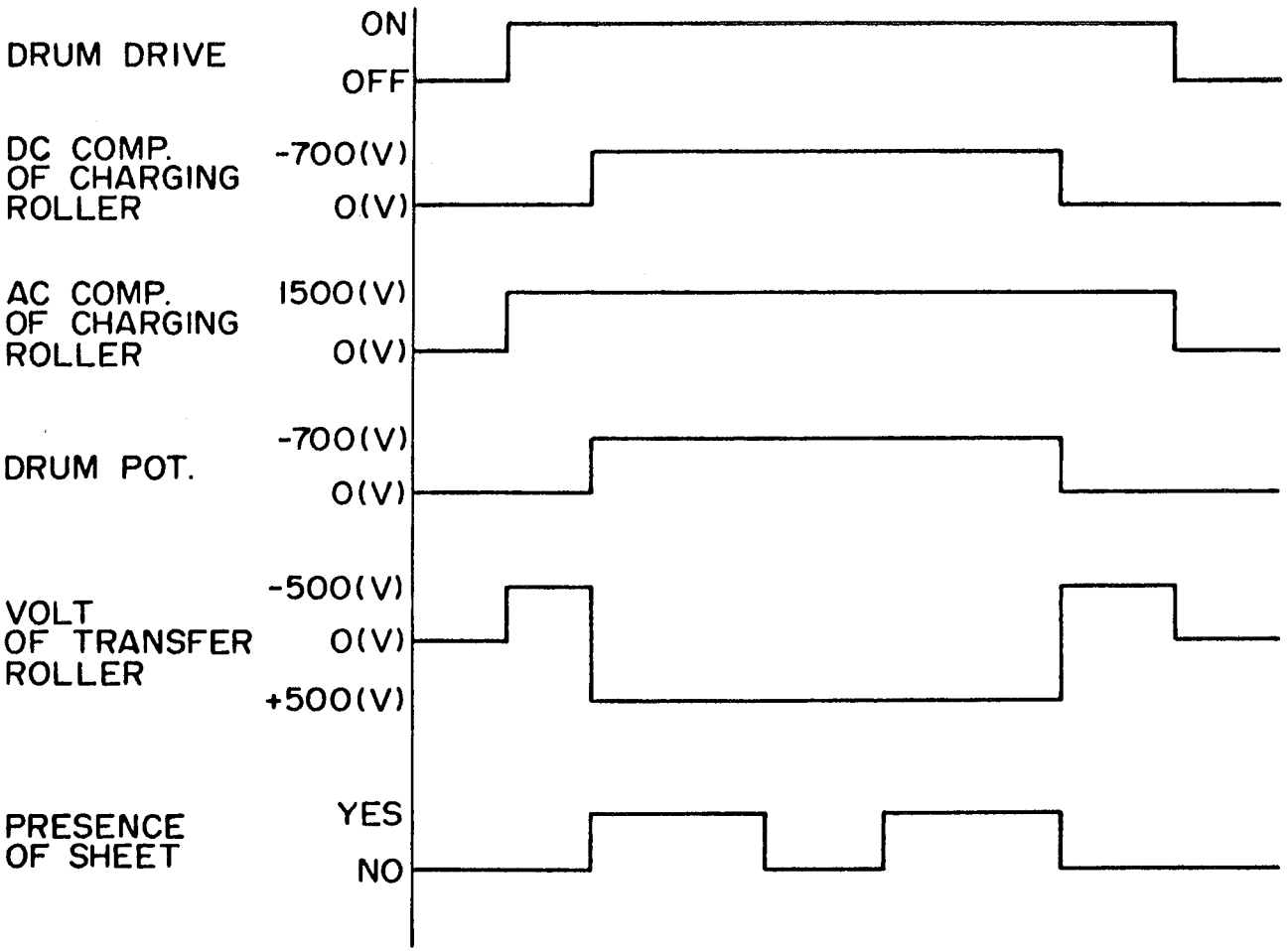

Since the transfer roller is mainly contaminated by jam or malfunction, the potentials of the charging roller 14 and the transfer roller 6 may be controlled only during the pre-rotation period or post-rotation period, as shown in FIG. 4B. Without changing the potentials of the rollers during the non-passage of the transfer material between adjacent transfer material passages in the continuous image forming operation, thus performing no cleaning of the transfer roller, a good image can be provided. It is possible that the cleaning of the transfer roller in the manner described above is performed during a part of the non-passage period.

The voltage source for applying bias voltage to the transfer roller 6 may be common with the power source for applying a voltage to the charging device, and the intended performance can be provided by a relatively low voltage source, whereby the size of the apparatus can be reduced.

Figure 5A:
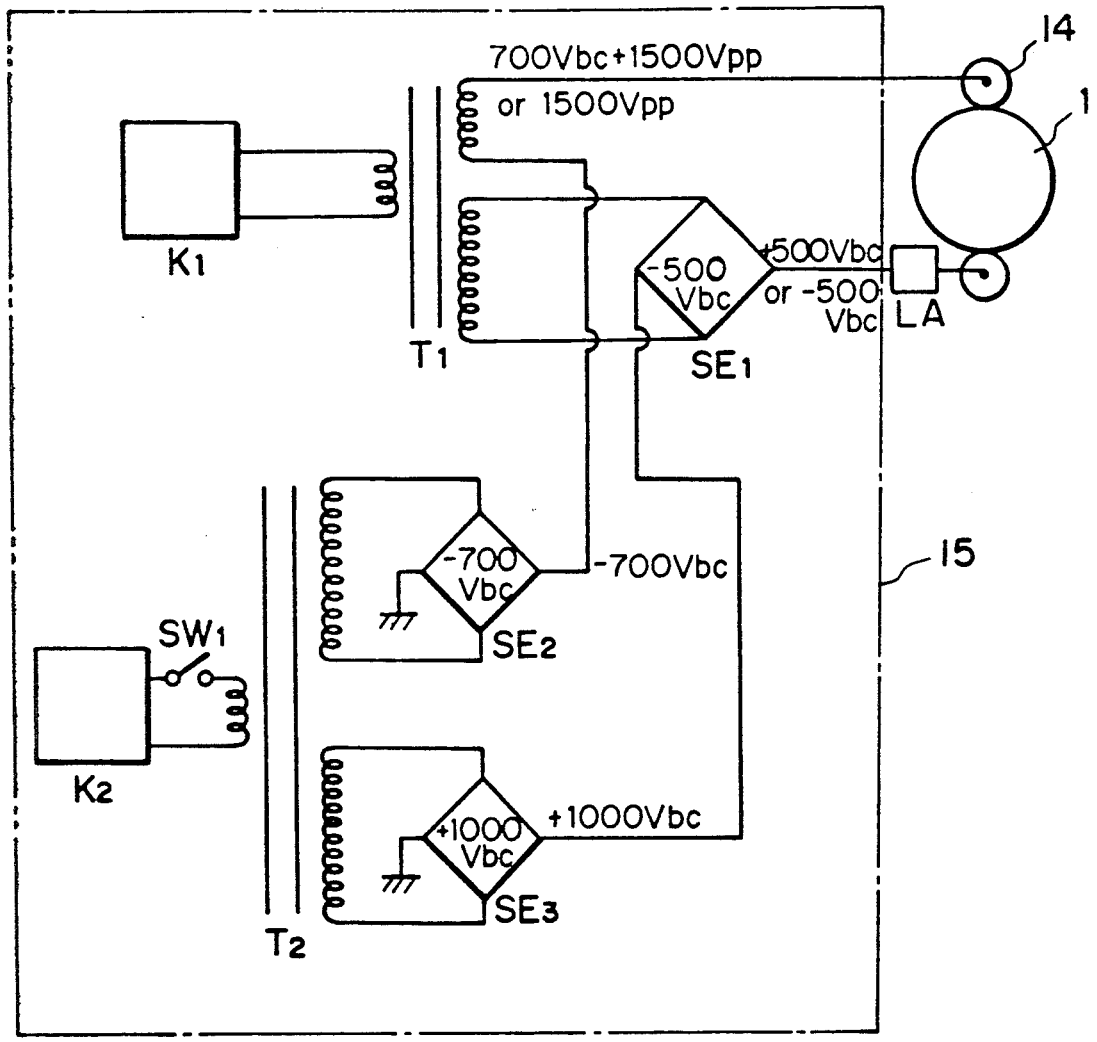
FIGS. 5A and 5B are circuit diagrams illustrating power source for the image forming apparatus.

Referring to FIG. 5A, there is shown an example of a structure of the power source 15. When a switch SW1 of a driver circuit K2 is actuated, a voltage of −700 V is produced through a transformer T2 and a rectifier SE2, and a voltage of +1000 V is produced through a rectifier SE3. A driver circuit K1 always produces an alternating voltage whenever the photosensitive member is driven, and a voltage of 1500 V (peak-to-peak voltage) is produced through a transformer T1, and a voltage of −500 V is produced by a rectifier SE1.

Therefore, by actuating the switch SW1, a superimposed voltage of −700 V (DC) and 1500 V (AC, peak-to-peak voltage) is applied to the charging roller 14 and +500 V is applied to the transfer roller 6.

In order to clean the transfer roller 6, the switch SW1 is rendered off, by which only an AC voltage of peak-to-peak voltage of 1500 V is applied to the charging roller 14, and −500 V is applied to the transfer roller 6, whereby the negatively charged toner is returned to the photosensitive member 1.

Since it requires a certain time for a portion of a surface of the photosensitive member 1 moves from the position of the charging roller 14 to the position of the transfer roller 6, it is preferable to provide a delaying circuit LA in the transfer roller 6 side to compensate the time lag.

Figure 5B:
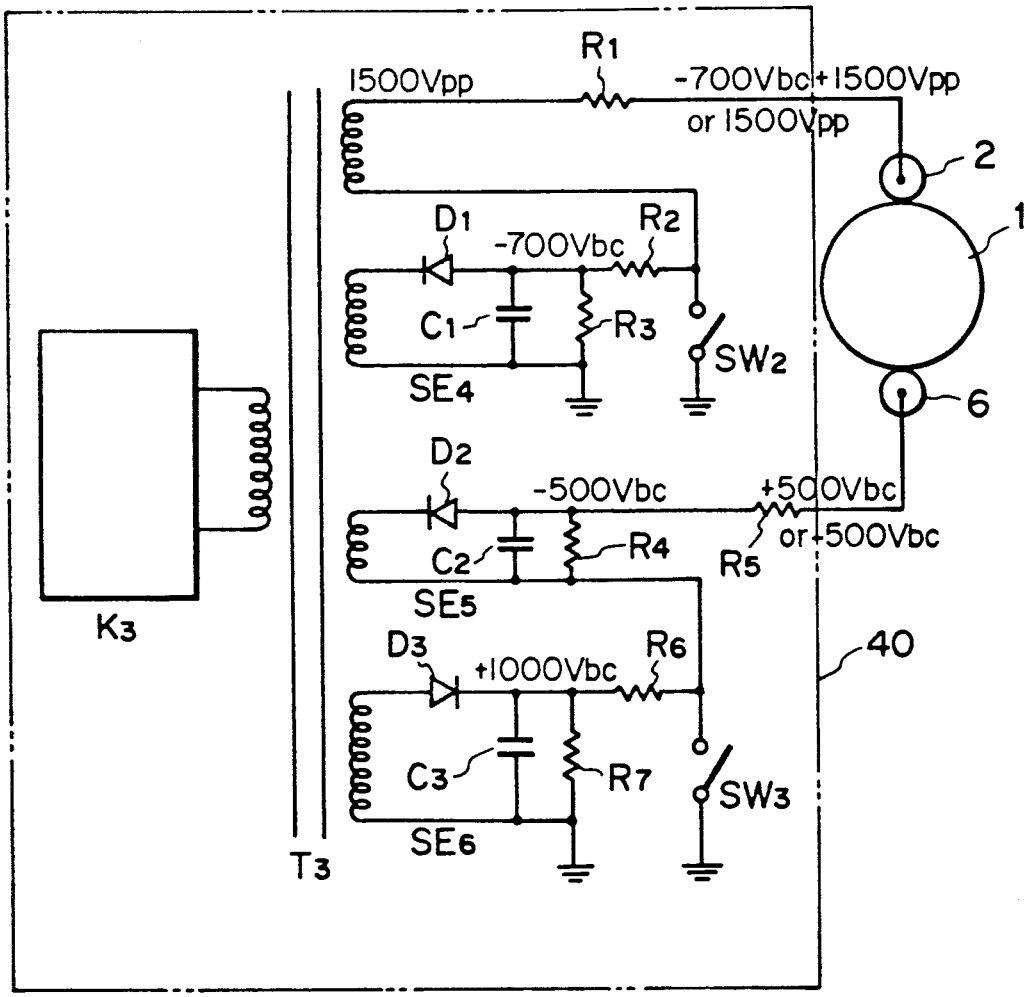

FIG. 5B shows another example of the power source, wherein references D1, D2 and D3 designate diodes; C1, C2 and C3 capacitors; and R1 thru R7 resistors.

The driving circuit K3 always produces an alternating voltage whenever the photosensitive member 1 is driven.

By opening the switch SW2, the charging roller 14 is supplied through a transformer T3 with a superposed voltage of an AC voltage having a peak-to-peak voltage of 1500 V and a DC voltage of −700 V produced by a rectifier SE4. By closing the switch SW2, it is supplied only with a DC voltage of 1500 V.

By opening the switch SW3, the transfer roller 6 is supplied with +500 V, while by closing the switch SW3, it is supplied with −500 V.

In this device, only one transformer is necessitated, and a half-wave rectifier which is less expensive is used, and therefore, the cost can be decreased.

In the foregoing embodiments, the DC component of the charging roller 14 is rendered 0 V during the cleaning operation of the transfer roller 6, it may be, as described hereinbefore, made higher than the voltage (−500 V in the examples) applied to the transfer roller 6, for example, it may be made −100 V.

Figure 6:
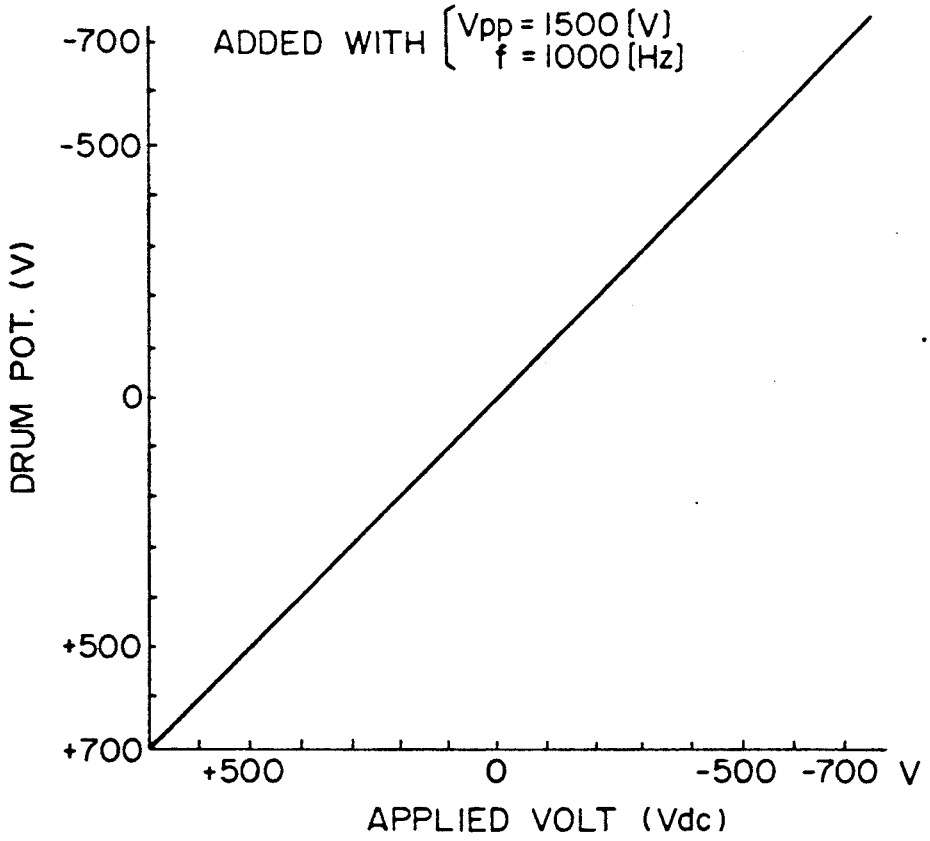
FIG. 6 is a graph showing a relation between a surface potential of a photosensitive member and a DC voltage applied to the charging member.

FIG. 6 is a graph showing change of the surface potential of the photosensitive member 1 relative to change of the DC component of the voltage applied to the charging roller 14 with the AC component being fixed to be 1500 V of the peak-to-peak voltage and 1000 Hz of the frequency.

From this, it is understood that the surface potential can be freely changed so that the DC component and the surface potential of the photosensitive member can be made equivalent so as to sufficiently clean the transfer roller 6, and therefore, the charging roller 14 is very advantageous over the corona charger 2.

Figure 7:
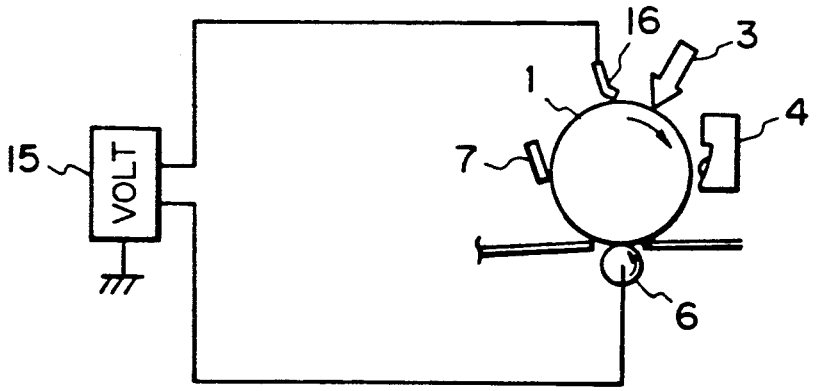
FIGS. 7 and 8 are sectional views of the image forming apparatuses according to the embodiments of the present invention.
Figure 8:
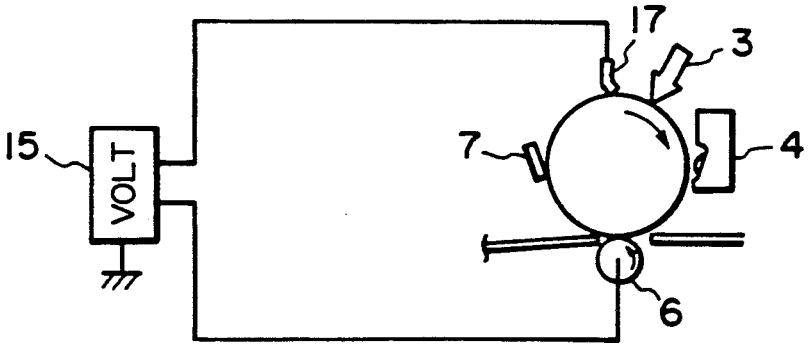

FIGS. 7 and 8 show further embodiments. In FIG. 7, the means for uniformly charging the photosensitive member is a blade 16 made of conductive rubber. In FIG. 8, it is a conductive brush 17. Both of them are in sliding contact with the photosensitive member 1. With these structures, the same effects can be provided as described above.

In the manner described above, the image forming operation and the image transfer operation are repeated. Also as mentioned hereinbefore, when the image forming operation is resumed after a temporary stop of the apparatus due to jam occurrence or the like, the toner deposited on the portion of the photosensitive member where the toner image has been formed by the developing device 4 prior to the stoppage and where the toner image has not yet been transferred is directly contacted to the transfer roller 6 at the initial stage of the resumption, and therefore, the toner is directly transferred onto the transfer roller 6.

In order to obviate this problem, it is possible for a warming up time period to be provided when the power supply is resumed after interruption of the power supply due to jam occurrence or the like, and that an electric field for transferring the toner from the transfer roller 6 to the photosensitive member, by which the transfer roller 6 is cleaned.

In connection with the embodiment of FIG. 1, the transfer roller 6 is supplied with 500 V having a polarity which is the same as that of the negatively charged toner, and the operations of the charger 2 and the developing device 4 are stopped, whereas only the discharging lamp 9 is operated, so that the surface potential of the photosensitive member 1 is attenuated down to 0 V. Such a warming up period is continued at least during a period from a point of time when a certain point on the photosensitive member 1 is at the developing device 4 to the point of time when it reaches the nip N between the transfer roller 6 and the photosensitive member 1.

In the embodiment of FIG. 1, assuming that the diameter of the photosensitive member 1 is 60 mm, and the peripheral speed thereof is 20 mm/sec, the warming up period is selected as to be not less than 3 seconds, and after the warming up period, the apparatus is placed in a stand-by period in which the image forming operation is possible.

With this structure, even in the case where the image forming operation is once stopped, and is resumed, the toner image formed between the developing station and the transfer station is not transferred to the transfer roller 6, and is passed through the transfer station as it is to reach the cleaning device, and is removed thereby, and therefore, it can be avoided that such toner is deposited to the transfer roller 6 and contaminates the subsequent transfer material.

Figure 9:
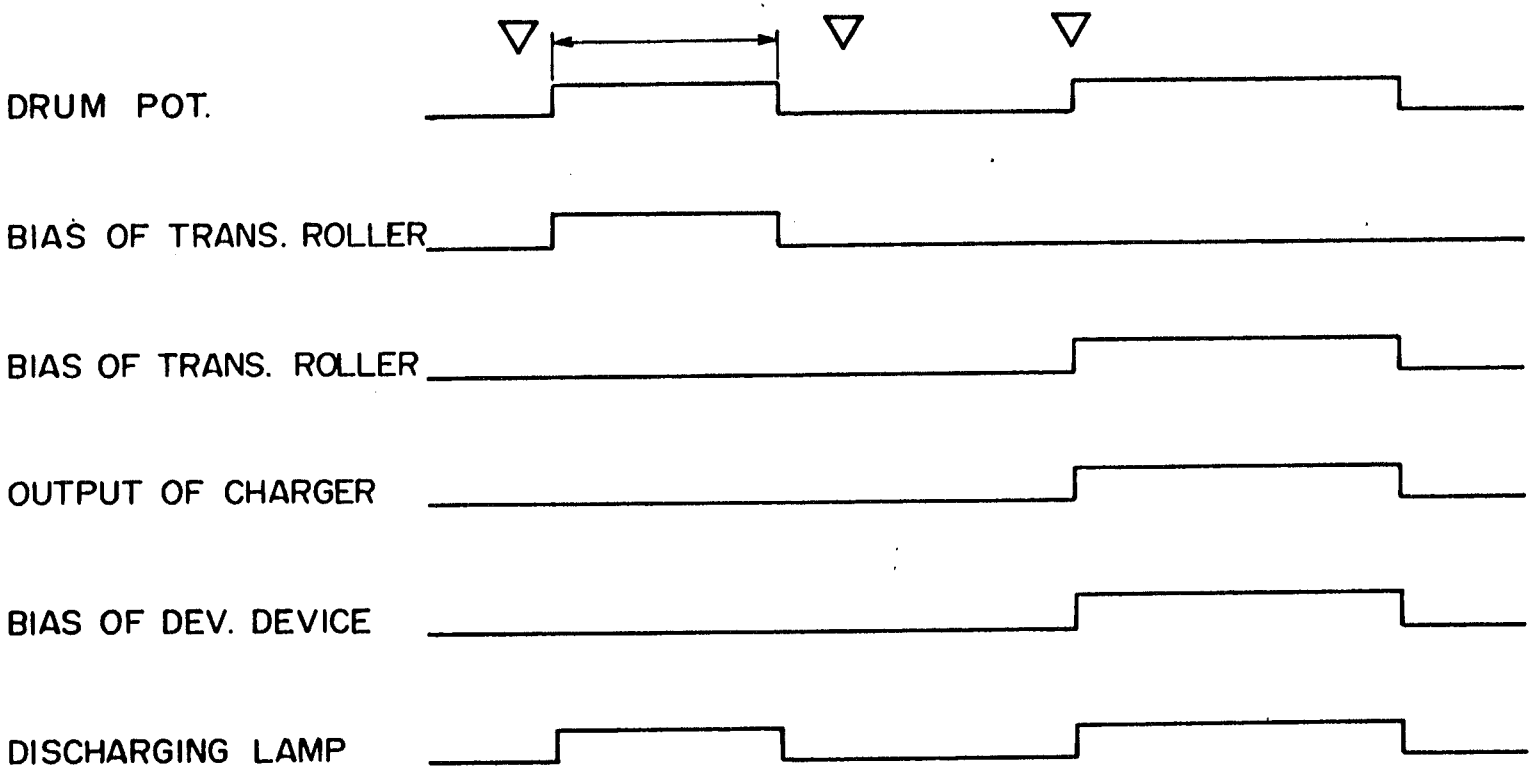
FIG. 9 is a timing chart for the embodiments of FIGS. 7 and 8.

FIG. 9 is a timing chart showing an example of such an image forming apparatus. By selecting the warming-up time period so as to be longer than the time required for the transfer roller 6 to rotate through one full turn, the transfer material 10 can be prevented from contamination with the toner which is already deposited on the transfer roller 6 at the time of the re-supply of the power, due to toner particles suspending in the apparatus.

In this case, the diameter of the transfer roller 6 is 30 mm, and the peripheral speed is the same as that of the photosensitive member, the warming-up period is not less than 5 seconds. In the description of the foregoing embodiments, the photosensitive member 1 is negatively charged, and the latent image is reverse-developed with negatively charged toner, but the same concept is applicable to the case where the latent image is regularly developed.

For example, the photosensitive member is charged to 700 V, and the laser scanning device 3 applies light modulated in accordance with an image signal to project light to the white area, by which a latent image is formed on the photosensitive member, and the latent image is regularly charged by positively charged toner with a DC developing bias of 300 V. The transfer roller is supplied with a transfer bias voltage of −1500 V, so as to transfer the toner image from the photosensitive member 1 to the transfer material 10.

Figure 12:
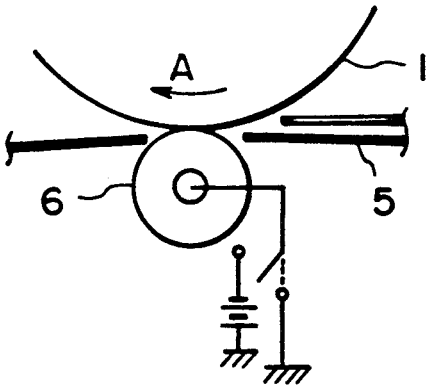
FIG. 12 is a schematic view of a power source for applying a voltage to the transfer roller.

In this case, in order to clean the transfer roller 6, a bias voltage having the same polarity as the positively charged toner is applied to the transfer roller 6 during the non-transfer operation, and the region of the photosensitive member 1 which is opposed to the transfer roller 6 during the non-transfer operation is made to have a voltage of approximately 0 V by controlling the charger 2. Because it is about 0 V, it is not developed by the positively charged toner. By making the bias voltage to the transfer roller 6 during the non-transfer operation the same as the positively charged toner, the transfer roller 6, in effect, applies to the photosensitive member 1 the electric charge having the polarity opposite to the charge polarity (negative) for charging the photosensitive member 1 by the charger 2. When the electric charge having the polarity opposite to the charging polarity of the photosensitive member 1 is deposited on the photosensitive member 1, the charge can not be erased even by the discharging lamp 9, and therefore, it remains as a memory in the next image. Therefore, it is preferable that the bias voltage to the transfer roller 6 during the non-transfer operation is preferably 0 V (FIG. 12) or has a polarity opposite to that of the toner. At this time, the region of the photosensitive member 1 which is to be opposed to the transfer roller 6 during the non-transfer operation is charged by the charger 2 to such a level as is higher than the charging level during the image formation, for example, −900 V and on the other hand, the developing bias of the developing device 4 is made near 900 V. By doing so, an electric field for transferring the positively charged toner from the transfer roller 6 to the photosensitive member 1 is formed, and therefore, similarly to the case described above, the contamination of the transfer material 10 can be prevented.

It has been found that when the image transfer operation is executed in the apparatus described above, the amount of the toner which is once deposited on the transfer roller 6 and is transferred to the photosensitive member 1 is significantly varied depending on the press-contact pressure between the transfer roller 6 and the photosensitive member 1.

Figure 10A:
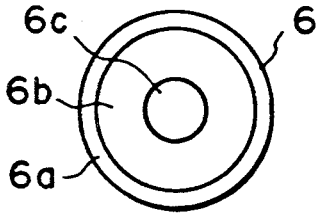
FIGS. 10A, 10B and 10C are sectional views illustrating a transfer roller.

FIG. 10A shows a transfer roller 6 which comprises a metal core 6c, and inside layer 6b made of conductive urethane sponge and an outside layer of solid urethane rubber having electrical conductivity.

Figure 11:
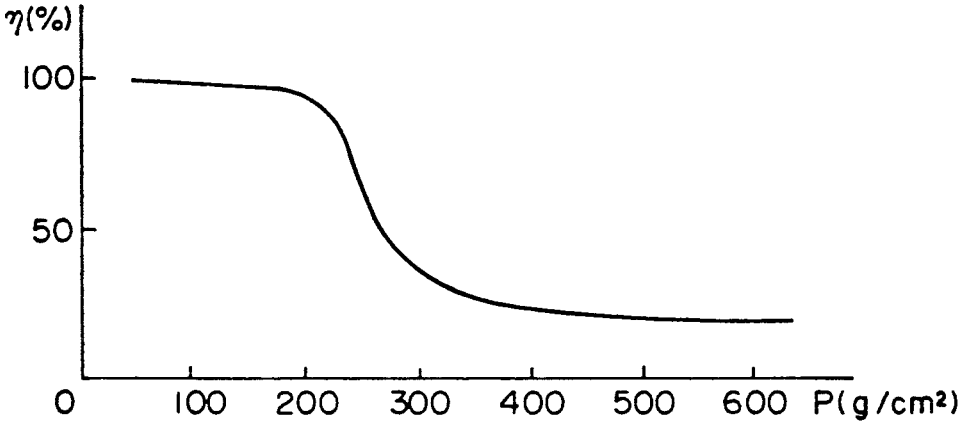
FIG. 11 is a graph showing a relation between an image transfer efficiency and pressure-contact force of transfer roller to a photosensitive member.

FIG. 11 shows change of the cleaning efficiency relative to the contact pressure between such a transfer roller 6 and the photosensitive member 1. The transfer efficiency is defined by a percentage of the amount of the toner transferred to the photosensitive member 1 when the transfer roller 6 having toner particles deposited thereon is rotated through three full turns.

As will be understood from FIG. 11, the cleaning efficiency is significantly improved when the contact pressure is not more than 300 g/cm$^2$.

Using the above-described transfer roller 6, when the contact pressure between the transfer roller 6 and the photosensitive member 1 was set at 200 g/cm$^2$, the nip width of 2 mm could be provided, and the image transfer properties and the sheet conveying properties were without problem, and the cleaning of the transfer roller 6 was so good that the backside of the transfer material was not contaminated. If the contact pressure was decreased, the nip width was decreased, and therefore, the image transfer became insufficient, and the image can be blurred. In view of this, it is preferable that the hardness (JIS (Japanese Industrial Standard) A) of the transfer roller 6 is not more than 30 degrees. Further in view of this, the roller is of a two layer structure wherein the outside layer surface is made smooth, and the hardness thereof is slightly greater so as to prevent the toner from wedging into the roller surface and so as to increase the durability of the roller, whereas the hardness of the inside layer is made lower to provide the entire hardness in the preferable range. The measurement of the roller hardness was performed in accordance with JIS K-6301 using a JIS-A hardness measuring device (TECLOCK GS-706 available from TECLOCK).

Figure 10B:
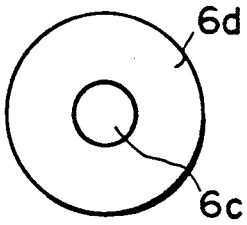
Figure 10C:
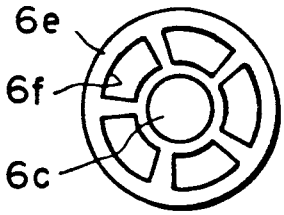

FIGS. 10B and 10C show another examples of transfer rollers 6. In FIG. 10B, it is made of a sponge-like conductive urethane rubber 10d having fine pores with pore diameter of approximately 10 microns. In FIG. 10C, it is made of a conductive rubber having plural cavities therein. With those rollers, the same effects can be provided as the transfer roller 6 shown in FIG. 10A.

Further, it is preferable that a surface roughness of the transfer roller 6 is not more than the average particle size of the used toner particles, usually not more than 10 microns, the surface roughness being determined on the basis of ten point average method, since then the image transfer efficiency is improved.

An example of such a transfer roller 6 can be made by adding a foaming agent into urethane which is made electrically conductive by dispersing and mixing thereinto carbon, and it is foamed in a hollow cylindrical metal mold. By doing so, the surface of the produced roller follows the inside surface of the metal mold to become a skin layer having a surface roughness not more than 10 microns (ten point average measurement), and the roller is electrically conductive.

The measurement of the surface roughness of the transfer roller 6 is performed in accordance with JIS-B-0601 using a surface configuration measuring device SE-3C available from Kosaka Laboratories, Japan.

The transfer roller was produced, having a core metal having a diameter of 6 mm, wrapped with foamed urethane having a conductivity of $10^2$ ohm.cm (volume resistivity) and having a thickness of 5 mm. The transfer roller thus had a diameter of 16 mm. The transfer roller 6 was produced in the manner described above, the surface thereof was abraded to provide the surface roughness Rz of 2s (A) and 10s (B). The roller was press-contacted to an OPC photosensitive drum having a diameter of 30 mm with a total pressure of 600 g, wherein the press-contacted area therebetween was 21 cm$\times$0.1 cm. A latent image having a dark potential of $-700$ V and light potential of $-100$ V was formed and was developed reversely with negative toner particles having an average particle size of 12 microns. During the image transfer operation, the transfer roller was supplied with $+500$ V. During the non-transfer operation, the transfer roller was cleaned in the manner described above, the transfer efficiency did not decrease even after several hundreds sheets were processed. The surface of the roller after the test was almost the same as prior to the test.

The transfer roller described above was the one press-contacted to the photosensitive member. However, it is possible to provide a small clearance depending on the thickness of the transfer material, between the transfer roller surface and the photosensitive member surface so that during the transfer operation (passage of the transfer material) the transfer roller press-contact the transfer material to the photosensitive member, whereas during the non-transfer operation, the toner deposited on the transfer roller is transferred to the photosensitive member through the small clearance.

As for the image bearing member, it is not limited to the photosensitive member, but it is possible to use an insulating drum. The transfer means is not limited to the transfer roller, but it may be in the form of an endless belt.

It is understood that the application of the present invention is not limited to the cleaning of the transfer means, but is applicable to charging means for charging the image bearing member, for example, the charging roller 14 described above.

As described in the foregoing, according to the present invention, by changing the potential of the image bearing member opposed to the charging electrode, an electric field effective to transfer the toner from the charging electrode to the image bearing member, and the transfer means can be effectively cleaned, by which a good quality of the image can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for electrically charging said image bearing member to a first potential;

latent image forming means for forming a latent image with use of said charging means;

developing means for developing the latent image formed by said latent image forming means with toner electrically charged to a polarity the same as a polarity of the first potential;

image transfer means contactable to a back side of a transfer material at a transfer position to transfer a toner image provided by said developing means from said image bearing member to the transfer material;

voltage application means for applying a voltage to said image transfer means, said voltage application means applying a voltage having a polarity the same as that of the toner to said image transfer means during non-transfer action by said transfer means; and means for providing a second potential for that portion of said image bearing member which is to be presented to the transfer position during said voltage application by said voltage application means, wherein the second potential is different from the first potential and is remote from the first potential in a direction opposite from a polarity of the electric charge of the toner.

2. An apparatus according to claim 1, wherein an absolute value of the second potential is lower than that of the first potential.

3. An apparatus according to claim 2, wherein said different potential providing means includes means for removing charge from said portion of said image bearing member.

4. An apparatus according to claim 3, wherein said image bearing member includes a photosensitive member, and the potential providing means includes means for projecting light to said photosensitive member.

5. An apparatus according to claim 1, wherein said charging means functions as said different potential providing means, and wherein an absolute value of the second potential is lower than that of the first potential.

6. An apparatus according to claim 5, wherein said charging means does not electrically charge said portion of said imagebearing member.

7. An apparatus according to claim 1, wherein said voltage application means applies a voltage having a polarity opposite to a polarity of the toner to the transfer means during the transfer action.

8. An apparatus according to claim 1, wherein said image transfer means is in the form of a roller.

9. An apparatus according to claim 1 or 8, wherein said transfer means is contactable to said image bearing member.

10. An apparatus according to claim 1, wherein said transfer means is press-contacted to said image bearing member with a pressure not more than 300 g/cm$^2$.

11. An apparatus according to claim 1 or 10, wherein said image transfer means has a hardness of not more than 30 degrees (JISA).

12. An apparatus according to claim 1, wherein said image bearing member includes a photosensitive member, and wherein said latent image forming means includes light application means for projecting onto the photosensitive member a light beam modulated in accordance with an image signal.

13. An apparatus according to claim 12, wherein said latent image forming means includes a laser scanning means for projecting a laser beam modulated in accordance with an image signal.

14. An apparatus according to claim 1, further comprising means for cleaning said image bearing member, disposed downstream of said image transfer means with respect to a rotational direction of movement of said image bearing member.

15. An apparatus according to claim 1, wherein said charging means is contactable to said image bearing member to electrically charge it.

16. An apparatus according to claim 15 wherein said charging means is in the form of a roller.

17. An apparatus according to claim 15, wherein said charging means is in the form of a blade.

18. An apparatus according to claim 15, wherein said charging means, when it is contacted to the portion of said image bearing member in which an electrostatic latent image is to be formed, is supplied with a superimposed voltage of an AC voltage and a DC voltage.

19. An apparatus according to claim 18, only an AC voltage is applied to said charging means when said portion of said image bearing member is contacted to said charging means.

20. An apparatus according to claim 1, said developing means, when said portion of said image bearing member is at said developing means, prevents toner deposition onto said image bearing member.

21. An apparatus according to claim 1, 7 or 15, wherein said voltage application means is capable of applying a voltage to said charging means.

22. An apparatus according to claim 1, wherein when said voltage application means applies the voltage, an electric field effective to transfer the toner from said transfer means to said image bearing member is formed.

23. An image forming apparatus, comprising:

a movable image bearing member;

means for electrically charging said image bearing member to a first potential;

latent image forming means for forming a latent image with use of said charging means;

developing means for developing the latent image formed by said latent image forming means with toner electrically charged to a polarity the same as a polarity of the first potential;

image transfer means contactable to a back side of a transfer material at a transfer position to transfer a toner image provided by said developing means from said image bearing member to the transfer material;

voltage application means for applying a voltage to said image transfer means, said voltage application means applying a voltage having a polarity the same as that of the toner to said image transfer means during non-transfer action by said transfer means; and means for providing a second potential for that portion of said image bearing member which is to be presented to the transfer position during said voltage application by said voltage application means, wherein the second potential is different from the first potential, wherein said different second potential is lower than an absolute value of the first potential, wherein said different potential providing means provides a potential having an absolute value for said portion of said image bearing member, the absolute value being smaller than an absolute value of a voltage applied to said image transfer means by said voltage applying means during non-transfer action.

24. An image forming apparatus, comprising:

a movable image bearing member;

charging means for electrically charging said image bearing member to a first potential;

latent image forming means for forming a latent image on said image bearing member with use of said charging means;

developing means for developing the latent image formed by said latent image forming means with toner;

image transfer means contactable to a back side a transfer material at a transfer position to transfer a toner image provided by said developing means from said image bearing member to the transfer material;

potential application means for applying to said image transfer means a second potential during non-transfer action of said image transfer means to form an electric field to transfer the toner from said transfer means to said image bearing member, and a third potential during transfer action of the image transfer means; and means for providing said image bearing member with such a potential that a difference between the second potential and a potential of that portion of said image bearing member which is to be presented to the transfer position during application of the second potential, is larger than a potential difference between the second potential and the first potential and the potential of that portion of the image bearing member is different from the first potential and is remote from the first potential in a direction opposite from a polarity of the electric charge of the toner.

25. An apparatus according to claim 24, wherein said first potential has a polarity opposite to a polarity of the second potential.

26. An apparatus according to claim 24, wherein an absolute value of the second potential is lower than that of the third potential.

27. An apparatus according to claim 24 or 26, wherein the second potential applied to said image transfer means is substantially 0 V.

28. An apparatus according to claim 24, wherein said potential providing means increases the potential of said portion of said image bearing member beyond the first potential.

29. An apparatus according to claim 28, wherein said potential providing means provides said portion of said image bearing member with a potential having an absolute value lower than an absolute value of the second potential.

30. An apparatus according to claim 24, wherein an absolute value of the potential of that portion of said image bearing member is lower than that of the first potential.

31. An apparatus according to claim 30, wherein said charging means functions as said potential providing means and does not electrically charge said portion of said image bearing member.

32. An apparatus according to claim 30, wherein said potential providing means includes means for removing charge from said portion of said image bearing member.

33. An apparatus according to claim 32, wherein said image bearing member includes a photosensitive member, and the potential providing means includes means for projecting light to said photosensitive member.

34. An apparatus according to claim 24, wherein said potential application means applies a potential having a polarity opposite to a polarity of the toner to the transfer means during the transfer action.

35. An apparatus according to claim 24, wherein said image transfer means is in the form of a roller.

36. An apparatus according to claim 22 or 35 wherein said transfer means is contactable to said image bearing member.

37. An apparatus according to claim 24, wherein said transfer means is press-contacted to said image bearing member with a pressure not more than 300 g/cm$^2$.

38. An apparatus according to claim 24 or 33, wherein said image transfer means has a hardness of not more than 30 degrees (JISA).

39. An apparatus according to claim 24, wherein said image bearing member includes a photosensitive member, and wherein said latent image forming means includes light application means for projecting onto the photosensitive member a light beam modulated in accordance with an image signal.

40. An apparatus according to claim 39, wherein said latent image forming means includes a laser scanning means for projecting a laser beam modulated in accordance with an image signal.

41. An apparatus according to claim 24, further comprising means for cleaning said image bearing member, disposed downstream of said image transfer means with respect to a rotational direction of movement of said image bearing member.

42. An apparatus according to claim 24, wherein said charging means is contactable to said image bearing member to electrically charge it.

43. An apparatus according to claim 42, wherein said charging means is in the form of a roller.

44. An apparatus according to claim 42, wherein said charging means is in the form of a blade.

45. An apparatus according to claim 42, wherein said charging means, when it is contacted to the portion of said image bearing member in which an electrostatic latent image is to be formed, is supplied with a superimposed voltage of an AC voltage and a DC voltage.

46. An apparatus according to claim 45, only an AC voltage is applied to said charging means when said portion of said image bearing member is contacted to said charging means.

47. An apparatus according to claim 46, said developing means, when said portion of said image bearing member is at said developing means, prevents toner deposition onto said image bearing member.

48. An apparatus according to claim 24 or 42, wherein said potential application means is capable of applying a voltage to said charging means.

49. An image forming apparatus, comprising:

a movable image bearing member for bearing a latent image and a developed image from the latent image;

a charging electrode contactable to said image bearing member at a charging position;

potential application means for applying a voltage to said electrode, said potential application means applying to said electrode a first potential when an image area of said image bearing member is in said charging position, and a second potential when a non-image area of said image bearing member is in said charging position; and means for providing said image bearing member with such a potential that a potential difference between the second potential and a potential of that portion of said image bearing member which is to be presented to the charging position during application of the second potential, is larger than a potential difference between the second potential and a high potential of the latent image constituted by the high potential and a low potential, wherein by the first mentioned potential difference, an electric field effective to transfer toner from said charging electrode to said image bearing member is formed.

50. An image forming apparatus, comprising:

a movable image bearing member;

charging means for electrically charging said image bearing member to a first potential;

latent image forming means for forming a latent image on said image bearing member with use of said charging means;

developing means for developing the latent image formed by said latent image forming means with toner;

image transfer means contactable to a back side of a transfer material at a transfer position to transfer a toner image provided by said developing means from said image bearing member to the transfer material;

potential application means for applying to said image transfer means a second potential during non-transfer action of said image transfer means to form an electric field to transfer the toner from said transfer means to said image bearing member, and a third potential during transfer action;

means for providing a fourth potential for that portion of said image bearing member which is to be presented to the transfer position during the second potential application by said potential application means, wherein an absolute value of the fourth potential is lower than that of the first potential;

wherein said transfer means is press-contacted to said image bearing member with a pressure not more than 300 g/cm$^2$.

51. An image forming apparatus, comprising:

a movable image bearing member;

charging means for electrically charging said image bearing member to a first potential;

latent image forming means for forming a latent image on said image bearing member with use of said charging means;

developing means for developing the latent image formed by said latent image forming means with toner;

image transfer means contactable to a back side of a transfer material at a transfer position to transfer a toner image provided by said developing means from said image bearing member to the transfer material;

potential application means for applying to said image transfer means a second potential during non-transfer action of said image transfer means to form an electric field to transfer the toner from said transfer means to said image bearing member, and a third potential during transfer action;

means for providing a fourth potential for that portion of said image bearing member which is to be presented to the transfer position during the second potential application by said potential application means, wherein the fourth potential is different from the first potential;

wherein said transfer means has a rubber hardness of not greater than 30 degrees (JISA).

52. An apparatus according to claim 51, wherein said transfer means is contactable to said image bearing member.

53. An image forming apparatus, comprising:

a movable image bearing member;

image forming means for forming a toner image on said image bearing member;

image transfer means contactable to a back side of an image transfer material at a transfer position to transfer the toner image from said image bearing member to the transfer material;

electric field forming means for forming an electric field between said image bearing member and said transfer means, said electric field forming means forming a first electric field effective to transfer the toner from said transfer means to said image bearing member and a second electric field bearing a direction opposite to that of the first electric field, when the transfer material is not present at the transfer position.

54. An apparatus according to claim 53, wherein;

said image transfer means is in the form of a roller.

55. An apparatus according to claim 53, further comprising means for cleaning said image bearing member, disposed downstream of said image transfer means with respect to a rotational direction of movement of said image bearing member.

56. An apparatus according to claim 53 or 54, wherein said transfer means is contactable to said image bearing member.

57. An apparatus according to claim 56, wherein said transfer means is press-contacted to said image bearing member with a pressure not more than 300 g/cm$^2$.

58. An apparatus according to claim 56, wherein said image transfer means has a hardness of not more than 30 degrees (JISA).

59. An apparatus according to claim 53, wherein said electric field forming means applies to said transfer means a potential having the same polarity as the toner, when the first electric field is formed.

60. An apparatus according to claim 53 or 59, wherein said electric field forming means applies to said transfer means a potential having a polarity opposite from that of the toner, when the second electric field is formed.

61. An apparatus according to claim 53, wherein said electric field forming means applies a DC voltage between said image bearing member and said transfer means.

62. An image forming apparatus, comprising:

a movable image bearing member;

means for electrically charging said image bearing member to a first potential;

toner image forming means for forming a toner image on said image bearing member;

image transfer means contactable to a back side of a transfer material at a transfer position to transfer the toner image from said image bearing member to the transfer material;

potential application means for applying a second potential to said transfer means when the transfer material is not at the transfer position;

potential providing means for providing a third potential for that portion of said image bearing member which is to be presented to the transfer position during the second potential application by said potential applying means, the third potential is different from the first potential and is remote from the first potential in a direction opposite from a polarity of the electric charge of the toner.

63. An apparatus according to claim 62, wherein said image forming means forms the image with aid of said charging means.

64. An apparatus according to claim 62, wherein during application of the second potential, an electric field is formed at the transfer position in a direction for transferring the toner from said transfer means to said image bearing member.

65. An apparatus according to claim 62 or 64, wherein the second potential has a polarity which is the same as that of toner charge.

66. An apparatus according to claim 62 or 63, wherein the first potential has a polarity which is the same as that of toner charge.

67. An apparatus according to claim 66, wherein the third potential has a polarity which is the same as that of the first potential and an absolute value of the second potential is higher than that of the first potential.

68. An apparatus according to claim 67, wherein said charging means also functions as said potential providing means.

69. An apparatus according to claim 68, wherein said charging means does not charge said portion of said image bearing member.

70. An apparatus according to claim 67, wherein said potential providing means also functions to remove electric charge from said portion of said image bearing member.

71. An apparatus according to claim 70, wherein said image bearing member includes a photosensitive member, and the different potential providing means includes means for projecting light to said photosensitive member.

72. An apparatus according to claim 67, wherein the second potential has the same polarity as that of the first potential and an absolute value of the second potential is higher than that of the first potential.

73. An apparatus according to claim 62 or 63, wherein said charging means also functions as said potential providing means.

74. An apparatus according to claim 73, wherein said charging means does not charge said portion of said image bearing member.

75. An apparatus according to claim 62, wherein said transfer means is contactable to said image bearing member.

76. An apparatus according to claim 62 or 75, wherein said image transfer means is in the form of a roller.

77. An apparatus according to claim 75, wherein said transfer means is press-contacted to said image bearing member with a pressure not more than 300 g/cm$^2$.

78. An apparatus according to claim 75, wherein said image transfer means has a hardness of not more than 30 degrees.

79. An apparatus according to claim 78, wherein said charging means also functions as said potential providing means.

80. An image forming apparatus, comprising:

a movable image bearing member;

means for electrically charging said image bearing member to a first potential;

toner image forming means for forming a toner image on said image bearing member;

image transfer means contactable to a back side of a transfer material at a transfer position to transfer the toner image from said image bearing member to the transfer material;

potential application means for applying a second potential to said transfer means when the transfer material is not at the transfer position;

potential providing means for providing a third potential for that portion of said image bearing member which is to be presented to the transfer position during the second potential application by said potential applying means, wherein a first electric field is formed during potential application by said potential applying means at the transfer position by the second and third potentials, the first electric field being effective to transfer the toner from said transfer means to said image bearing member, and wherein a second electric field is formed at the transfer position by the first and second potential, and wherein said first electric field is more effective to transfer the toner from said transfer means to said image bearing member than said second electric field.

81. An apparatus according to claim 80, wherein said image forming means forms the image with the aid of said charging means.

82. An apparatus according to claims 80 or 81, wherein the first potential has a polarity which is the same as that of toner charge.

83. An apparatus according to claim 82, wherein the third potential has a polarity which is the same as that of the first potential and an absolute value of the third potential is lower than that of the first potential.

84. An apparatus according to claim 83, wherein said charging means also functions as said potential providing means.

85. An apparatus according to claim 82, wherein the second potential has the same polarity as that of the first potential and an absolute value of the second potential is higher than an absolute value of the first potential.

86. An apparatus according to claim 80, wherein the second potential has a polarity which is the same as that of toner charge.

87. An apparatus according to claim 80 or 81, wherein said charging means also functions as said potential providing means.

88. An apparatus according to claim 87, wherein said charging means does not charge said portion of said image bearing member.

89. An apparatus according to claim 80, wherein said image transfer means is in the form of a roller.

90. An apparatus according to claim 80, wherein said transfer means is press-contacted to said image bearing member with a pressure not more than 300 g/cm$^2$.

91. An apparatus according to claim 80, wherein said image transfer means has a hardness of not more than 30 degrees (JISA).

92. An apparatus according to any one of claims 80, 89, 90 and 91, wherein said transfer means is contactable to said image bearing member.

* * * * *

UNITED STATES PATENT AND TRADEMARK OFFICE

CERTIFICATE OF CORRECTION

PATENT NO. : 5,132,738

DATED : July 21, 1992

INVENTOR(S) : Shunji NAKAMURA, et al.

It is certified that error appears in the above-identified patent and that said Letters Patent is hereby corrected as shown below:

TITLE PAGE:

[56] REFERENCES CITED:

"61-53688 3/1986 Japan" should read --61-53668 3/1986 Japan--.

COLUMN 15

Line 45, "imagebearing" should read --image bearing--.

COLUMN 17

Line 13, "side" should read --side of--.

COLUMN 18

Line 9, "claim 22" should read --claim 24--.
Line 15, "or 33," should read --or 37,--.
Line 45, "claim 45," should read --claim 45, wherein--.
Line 49, "claim 46," should read --claim 24,--.

Signed and Sealed this

Twenty-eighth Day of September, 1993

Bruce Lehman

*Attest:*

BRUCE LEHMAN

*Attesting Officer*

*Commissioner of Patents and Trademarks*